US005599442A

United States Patent [19]

McRae et al.

[11] Patent Number: 5,599,442

[45] Date of Patent: Feb. 4, 1997

[54] COLLECTOR COMPOSITION FOR FLOTATION OF ACTIVATED SPHALERITE

[75] Inventors: Colin McRae, Maroubra; Danny Lee, Perth, both of Australia; Peter Avotins, Easton, Conn.

[73] Assignee: Cytec Technology Corp., Wilmington, Del.

[21] Appl. No.: 665,170

[22] Filed: Jun. 14, 1996

[51] Int. Cl.[6] ..... B03D 1/02; B03D 1/06; B03D 1/004

[52] U.S. Cl. ..... 209/166; 252/61

[58] Field of Search ..... 209/166, 167; 252/61

[56] References Cited

U.S. PATENT DOCUMENTS

| | | |
|---|---|---|
| 1,671,590 | 5/1928 | Keller . |
| 1,837,852 | 12/1931 | Chistmann . |
| 3,925,218 | 12/1975 | Zipperian . |
| 4,040,950 | 8/1977 | Zipperian . |
| 4,387,034 | 6/1983 | Unger . |
| 4,482,500 | 11/1984 | Lewellyn . |
| 4,584,097 | 4/1986 | Fu . |
| 4,699,712 | 10/1987 | Unger . |
| 4,702,822 | 10/1987 | Klimpel . |
| 5,094,746 | 3/1992 | Bush . |
| 5,232,581 | 8/1993 | Roberts . |

FOREIGN PATENT DOCUMENTS

| | | |
|---|---|---|
| 833326 | 6/1981 | U.S.S.R. . |
| 914553 | 3/1982 | U.S.S.R. . |
| 2106804 | 4/1983 | United Kingdom . |

*Primary Examiner*—Thomas M. Lithgow
*Attorney, Agent, or Firm*—Bernard Lau

[57] ABSTRACT

New and improved processes and compositions for use in flotation recovery of metal values from base metal zinc sulfide ores are disclosed. The collector compositions for froth flotation of metal sulfide minerals comprise the combination of combination of 1) at least one allylalkylthionocarbamate compound having the formula $$CH_2{=}CHCH_2NHC(=S)-OR,$$

wherein R is a $C_2$ to $C_8$ alkyl radical, preferably R is an isobutyl group, and 2) a xanthate having the formula $$R'O-C(=S)-S^-M^+,$$

wherein R' is a $C_2$ to $C_8$ alkyl radical, preferably a $C_4$ radical. More preferably, the $C_4$ radical of the xanthate is a butyl or isopropyl group. Preferably, the concentration of allylalkylthionocarbamate to xanthate of a ratio of from about 1:99 to about 50:50 percent by weight.

17 Claims, No Drawings

COLLECTOR COMPOSITION FOR FLOTATION OF ACTIVATED SPHALERITE

FIELD OF THE INVENTION

The present invention relates to flotation processes and collector compositions for use in such processes for recovery of metal values. More particularly, it relates to new and improved collector compositions for the flotation of activated sphalerite, the compositions comprising synergistic combinations of allylalkylthionocarbamates and xanthates which exhibit an excellent selective recovery of base metal zinc sulfides.

BACKGROUND OF THE INVENTION

Froth flotation is one of the most widely used processes for beneficiating ores containing valuable minerals. It is especially useful for separating finely ground valuable minerals from their associated gangue or for separating valuable minerals from one another. Flotation is based on the affinity of suitably prepared mineral surfaces for air bubbles. A froth or a foam is formed by introducing air into an agitated pulp of the finely ground ore in water containing a frothing or foaming agent. A chief advantage of separation by froth flotation is that it is a relatively efficient operation at a substantially lower cost than many other processes.

Current theory and practice state that the success of a sulfide flotation process depends to a great degree on the reagent(s) called collector(s) that impart(s) selective hydrophobicity to the value sulfide mineral that has to be separated from other minerals. Thus, the flotation separation of one mineral species from another depends upon the relative wettability of mineral surfaces by water. Typically, the surface free energy is purportedly lowered by the adsorption of heteropolar collectors. The hydrophobic coating this provides acts in this explanation as a bridge so that the mineral particles may be attached to an air bubble. The practice of this invention is not, however, limited by this or other theories of flotation.

In addition to the collector, several other reagents are necessary. Among these, frothing agents are used to provide a stable flotation froth, persistent enough to facilitate the mineral separation, but not so persistent that it cannot be broken down to allow subsequent processing. The most commonly used frothing agents are pine oil, creosote, cresylic acid and alcohols such as 4-methyl-2-pentanol, polypropylene glycols and ethers, etc.

Moreover, certain other important reagents, such as modifiers, are also largely responsible for the success of flotation separation of sulfide minerals. Modifiers include all reagents whose principal function is neither collecting or frothing, but one of modifying the surface of a mineral so that a collector either adsorbs to it or does not. Modifying agents can thus be considered as depressants, activators, pH regulators, dispersants, deactivators, etc. Often, a modifier may perform several functions simultaneously. Current theory and practice of sulfide flotation suggest that effectiveness of all classes of flotation agents depends to a large extent on the degree of alkalinity or acidity of the ore pulp.

The development of neutral derivatives of xanthates such as alkyl xanthogen alkyl formates are disclosed as sulfide collectors are known in the art and are disclosed in, for example, U.S. Pat. No. 2,412,500. In the '500 patent, alkyl xanthogen formates which are unsymmetrical with respect to the alkyl radicals are shown to be highly effective flotation reagents which may be employed advantageously as mineral collecting agents in conjunction with frothing agents and conditioning agents in froth flotation operations. Other structural modifications of the general structure were disclosed in U.S. Pat. No. 2,608,572, for example, alkyl formate substitutents containing unsaturated groups. In U.S. Pat. No. 2,608,573, the alkyl formate substitutents described contain halogen, nitrile and nitro groups. Bis alkyl xanthogen formates are described as sulfide collectors in U.S. Pat. No. 2,602,814. The '814 patent provides dicarbonyl compounds comprising organic dithio acid radicals and dicarbonyl compounds in which the carbonyl groups are joined together by means of multivalent organic radicals.

Another class of sulfide collectors which have obtained some degree of commercial success in froth flotation are oily sulfide collectors comprising dialkylthionocarbamate or diurethane compounds. In U.S. Pat. No. 2,691,635, a process for making dialkylthionocarbamates is disclosed. In U.S. Pat. No. 3,907,854, an improved process for making dialkylthionocarbamates is described. In U.S. Pat. No. 3,590,998, a thionocarbamate sulfide collector structure in which the N-alkyl substitutent is joined by alkoxycarbonyl groups is disclosed. In Reissue U.S. Pat. No. 32,786, collector compositions for use in froth flotation processes using hydrocarboxycarbonyl thiourea is described. These patents are incorporated herein by reference.

The synergistic use of the mixtures of dialkylthionocarbamates and dithiophosphates has been disclosed as collectors for the recovery of copper from copper containing ores in U.S. Pat. No. 3,925,218 and the synergistic use of the mixtures of allylalkylthionocarbamates and dithiophosphates for the recovery of platinum group metals and gold is taught in U.S. Pat. No. 5,232,581. These patents however, do not include xanthate nor do they recognize the synergistic effects of allylalkylthionocarbamates and xanthates.

Although the use of dialkylthionocarbamates and xanthates separately may be used as collectors in flotation of sphalerite, there is a need for other chemical formulations that provide greater efficiency in this process.

Accordingly, it is an object of the present invention to provide a new and improved sulfide collector and flotation process for the beneficiation of sulfide minerals employing froth flotation methods.

SUMMARY OF THE INVENTION

In accordance to the above objective, the present invention provides a new and improved collector composition for the froth flotation of metal sulfide minerals comprising the combination of 1 ) at least one allylalkylthionocarbamate compound having the formula $$CH_2{=}CHCH_2NHC(=S)-OR,$$

wherein R is a $C_2$ to $C_8$ alkyl radical, preferably R is an isobutyl group, and 2) a xanthate selected from the formula $$R'O-C(=S)-S^-M^+,$$

wherein R' is also a $C_2$ to $C_8$ alkyl radical, preferably a $C_4$ radical, and more preferably, a butyl or isopropyl group. Preferably, the concentration of allylalkylthionocarbamate to xanthate of a ratio of from about 1:99 to about 50:50 percent, by weight.

Generally, and without limitation, the new and improved collector composition of this invention may be used in amounts of from about 0.005 to 0.5 pound per ton of ore, and preferably from about 0.01 to 0.3 pound per ton of ore, to effectively selectively recover metal and mineral values from base metal sulfide ores while selectively rejecting pyrite and other gangue sulfide or nonsulfides. The new and improved sulfide collectors of this invention may generally be employed independently of the pH of the pulp slurries. Again, without limitation, these collectors may be employed at pH values of from about 3.5 to 11.0, and preferably from about 4.0 to 10.0.

In accordance with another embodiment, the present invention provides a new and improved process for beneficiating ore containing sulfide minerals with selective rejection of pyrite and other gangue sulfides or non-sulfides, the process comprising: grinding the ore to provide particles of flotation size, slurrying the particles in an aqueous medium, conditioning the slurry with effective amounts of frothing agent and a metal collector, and floating the desired sulfide materials preferentially over pyrite and other gangue sulfides or non-sulfides by froth flotation procedures, the metal collector comprising the combination of 1 ) at least one allylalkylthionocarbamate compound having the formula $$CH_2{=}CHCH_2NHC(=S)-OR,$$

wherein R is a $C_2$ to $C_8$ alkyl radical, preferably R is an isobutyl group, and 2) a xanthate selected from the formula $$R'O-C(=S)-S^-M^+,$$

wherein R' is also a $C_2$ to $C_8$ alkyl radical, preferably a C4 radical. More preferably, the $C_4$ radical of the xanthate is a butyl or isopropyl group. Preferably, the concentration of allylalkylthionocarbamate to xanthate of a ratio of from about 1:99 to about 50:50 percent by weight.

In particularly preferred embodiments, a new and improved method for enhancing the recovery of copper from an ore containing a variety of copper activated sphalerite is provided wherein the collector is added to the flotation cell.

The present invention therefore provides a new class of sulfide collectors and a new and improved process for froth flotation of base metal sulfide ores. The collector based on the combination of allylalkylthionocarbamate and xanthate, and the new and improved processes of the present invention unexpectedly provide superior metallurgical recovery in froth flotation separations as compared with conventional sulfide collectors having individual thionocarbamates or xanthate alone.

Other objects and advantages of the present invention will become apparent from the following detailed description and illustrative working examples.

DETAILED DESCRIPTION OF THE INVENTION

In accordance to the present invention, sulfide metal and mineral values are recovered by froth flotation methods in the presence of a novel sulfide collector, the collector comprising the combination of 1 ) at least one allylalkylthionocarbamate compound having the formula $$CH_2{=}CHCH_2NHC(=S)-OR,$$

wherein R is a $C_2$ to $C_8$ alkyl radical preferably R is an isobutyl group, and 2) a xanthate selected from the formula $$R'O-C(=S)-S^-M^+,$$

wherein R' is also a $C_2$ to $C_8$ alkyl radical, preferably a $C_4$ radical. More preferably, the $C_4$ radical of the xanthate is a butyl or isopropyl group. Preferably, the concentration of allylalkylthionocarbamate to xanthate of a ratio of from about 1:99 to about 50:50 percent by weight.

As another embodiment of this invention, in a froth flotation process for beneficiating an ore containing sulfide minerals comprising forming slurry liberation-sized particles of the ore in an aqueous medium, conditioning the slurry with effective amounts of a frothing agent and a metal collector, respectively, and floating the desired sulfide minerals by froth flotation methods, the improvement comprising employing as the metal collector an effective amount of the combination of 1) an allylalkylthionocarbamate and 2) a xanthate each selected from the above formulae. In preferred embodiments, R' is butyl or isopropyl. In yet another embodiment, the metal collector is added in an amount of from about 0.005 to 0.51lb/T of core.

Allylalkylthionocarbamates can be produced using allyl or substituted allyl isothiocyanate and an aqueous salt solution. In the presence of a phase transfer catalyst (PTC) to provide an aqueous solution of an alkali metal or ammonium thiocyanate, the thiocyanate is reacted with an allyl or substituted allyl halide. The two resulting phases are separated and the allyl or substituted allyl isothiocyanate is then reacted with an aliphatic alcohol in the presence of a suitable catalyst at an elevated temperature. See, commonly assigned U.S. Pat. No. 4,482,500 to Lewellyn.

Several steps are involved in preparing this carbamate. The first step comprises reacting in the presence of a phase transfer catalyst, an alkali metal or ammonium cyanide, sulfur and an allyl halide in water as the reaction solvent to produce a reaction mixture comprising an organic phase containing an allyl isothiocyanate and an aqueous phase. Then, the aqueous phase is separated from the organic phase. Finally, the allyl isothiocyanate as produced above with an alcohol in the presence of a urethane catalyst to produce the N-allyl-O-alkyl thionocarbamate.

For the allylalkylthionocarbamate of the collector mixture as described above, the isobutyl derivative is preferred. Illustrative compounds for the allylalkylthionocarbamate include N-allyl-O-ethylthionocarbamate; N-allyl-O-t-butylthionocarbamate, N-allyl-O-isobutylthionocarbamate; N-allyl-O-octylthionocarbamate and the like.

For the xanthate of the collector mixture as described above, the butyl and the isobutyl derivatives are preferred.

In accordance with the present invention, the above-described combination of at least one allylalkylthionocarbamate compound having the formula $$CH_2{=}CHCH_2NHC(=S)-OR,$$

wherein R is a $C_2$ to $C_8$ alkyl radical, preferably R is an isobutyl group, and a xanthate selected from the formula $$R'O-\overset{\overset{\displaystyle S}{\|}}{C}-S^{-}M^{+},$$

wherein R' is also a $C_2$ to $C_8$ alkyl radical, preferably a $C_4$ radical employed as sulfide collectors in a new and improved froth flotation process which provides a method for enhancing of sulfides mineral values and more particularly under acidic, neutral, slightly alkaline and highly alkaline conditions.

In accordance with the present invention, the new and improved, essentially pH-independent, process for the beneficiation of mineral values from base metal sulfide ores comprises, firstly, the step of size-reducing the ore to provide ore particles of flotation size. As is apparent to those skilled in this art, the particle size to which an ore must be size reduced in order to liberate mineral values from associated gangue or non-values, i.e., liberation size, will vary from ore to ore and many depend on several factors, such as, for example, the geometry of the material deposits within the ore, e.g., striations, agglomeration, comatrices, etc. In any event, as is common in this art, a determination that particles have been reduced to liberation size may be made by microscopic examination. Generally, and without limitation, suitable particle size will vary from between about 50 mesh to finer than about 400 mesh sizes. Preferably, the ore will be size-reduced to provide flotation sized particles of between about +65 mesh and about −200 mesh. Especially preferably for use in the present method are base metal sulfide ores which have been size-reduced to provide from about 14% to about 30% by weight of particles of +100 mesh and from about 45% to about 75% by weight of particles of −200 mesh sizes.

Size-reduction of the ores may be performed in accordance with any method known to those skilled in this art. For example, the ore can be crushed to −10 mesh size followed by wet grinding in a steel ball mill to specified mesh size or pebble milling may be used. The procedure employed in size-reducing the ore is not critical to the method of this invention, as long as particles of effective flotation size are provided. Preadjustment of pH is conveniently performed by addition of the modifier to the grind during the size reduction step.

The size-reduced ore, e.g., comprising particles of liberation size, is thereafter slurried in aqueous medium to provide a floatable pulp. The aqueous slurry or pulp of flotation sized ore particles, typically in a flotation apparatus, is adjusted to provide a pulp slurry which contains from about 10 to 60% by weight of pulp solids, preferably 25 to 50% by weight and especially preferably from about 30% to about 40% by weight of pulp solids.

Thereafter the pH of the pulp slurry may be preadjusted, if deemed necessary, to any desired value by the addition of either acid or base, and typically sulfuric acid or lime are used for this purpose, respectively. A distinct advantage of the present process is that the new and improved sulfide collectors comprised of the combination of specific thionocarbamates and xanthates employed in the process of this invention do not generally require any preadjustment of pH and generally the flotation may be performed at the natural pH of the ore pulp, thereby simplifying the process, saving costs and reducing lime consumption and related plant shut-downs. Thus, for examples, good beneficiation has been obtained in accordance with the process of the present invention at pH values ranging between 3.5 to 11.0, and especially good beneficiation has been observed with pH values within the range of from about 4.0 to about 10.0 pH.

Modifiers may be used to aid in providing accepted means and conditions by which the flotation size is reduced from the ore particle as well as in providing a means for adjucting the pH to a level for good flotation. Copper sulfate is used herein as a modifier.

In accordance with a preferred embodiment of the process of the present invention, the flotation of copper, zinc and lead sulfides is performed at a pH of less than or equal to 10.0 and preferably less than 10.0. It has been discovered that in conducting the flotation at this pH, the new and improved collectors comprising the combination of thionocarbamate and xanthate of the present invention exhibit exceptionally, good collector strength, together with excellent collector selectivity, even at reduced collector dosages In any event and for whatever reason, the pH of the pulp slurry may be pre-adjusted if desired at this time by any method known to those skilled in the art.

After the pulp slurry has been prepared, the slurry is conditioned by adding effective amounts of frothing agent and a collector comprising the combination of thionocarbamate and xanthate compounds as described above. By "effective amount" is meant any amount of the respective components which provides a desired level of beneficiation of the desired metal values.

More particularly, any known frothing agent may be employed in the process of the present invention. By way of illustration such frothing agents as straight or branched chain low molecular weight hydrocarbon alcohols, such as $C_6$ to $C_8$ alkanols, 2-ethyl hexanol and 4-methyl-2-pentanol, also known as methyl isobutyl carbinol (MIBC) may be employed, as well as, pine oils, cresylic acid, polyglycol or monoethers of polyglycols and alcohol ethoxylates, to name but a few of the frothing agents which may be used as frothing agent(s) herein. Generally, and without limitation, the frothing agent(s) will be added in conventional amounts and amounts of from about 0.01 to about 0.2 pounds of frothing agent per ton of ore treated are suitable.

The new and improved sulfide collector compositions for use in the process of the present invention may generally be added in amounts of from about 0.005 to about 0.5 pound of collector per ton of ore and preferably will be added in amounts of from about 0.01 lb/ton to about 0.3 lb/ton of ore processed. In flotation wherein pyrite and other gangue sulfides are to be selectively depressed over copper sulfides, the amount of collectors employed will generally be between 0.01 lb/ton to 0.05 lb/ton.

Thereafter, in accordance with the process of the present invention, the conditioned slurry, containing an effective amount of frothing agent and an effective amount of collector comprising a combination of at least one thionocarbamate and xanthate compounds, is subjected to a frothing step in accordance with conventional froth flotation methods to flotate the desired sulfide mineral values in the froth concentrate.

It has also been surprisingly discovered that, contrary to the conventional belief that a neutral, oily collector is most effective when it is added to the grind instead of to the flotation cells, the new and improved collectors comprising of at least one thionocarbamate and xanthate of the present invention exhibit more efficient recovery when they are added to the flotation cell, as opposed to the grind. The novel collector composition of this invention, although water-insoluble for all practical purposes, have the distinct advantage of being easily dispersible. The novel collector composition when added to the flotation cell provide higher copper recovery in the first flotation together with improved copper recovery overall, indicating improved kinetics of flotation, to be more fully described hereinafter.

The process of the invention is further described and illustrated by the following example which is in no way limiting of the scope of the invention, but is provided for illustration purposes.

EXAMPLES 1 to 7

Sphalerite Recovery Using a Combination of Butyl Xanthate and Allylisobutylthionocarbamate Plant addition rates of butyl xanthate and copper sulfate ($CuSO_4$) in the zinc rougher/scavenger circuit were measured and the dosages calculated. The temperature of the zinc rougher feed was also measured and recorded. The plant conditions were simulated in the laboratory experiments.

Samples were collected from the zinc rougher feed outlet using a half moon cutter. The number of pulp samples collected vary, usually around 4 to 7 buckets each containing 3 liters of pulp. After stirring the ore pulp in a bucket thoroughly, the contents were transferred into a test cell. The pulp level was made up to the 2.6 liter mark. Then the pulp in the cell was heated to plant temperature before flotation.

Either the butyl xanthate and/or allylisobutylthionocarbamate test colleotor/s was added and the pulp conditioned for 1 minute before collecting a concentrate for 3 minutes. Second stage additions of butyl xanthate and/or allylisobutylthionocarbamate test colleotor/s (or equivalent) and $CuSO_4$ were added and again the pulp conditioned for 1 minute after which another 3 minute concentrate was floated. Finally, a butyl xanthate and/or allylisobutylthionocarbamate test collector/s (or equivalent) addition was administered into the cell, allowed to condition for a minute before a third concentrate was removed from the cell for 3 minutes.

In Table I, the concentrate and tailing samples were dewatered and analyzed for their zinc content. The trial was repeated and the average of percent zinc recovered was also repeated.

TABLE I

| Examples | % allylisobutyl-thionocarbamate | % butyl xanthate | % zinc recovered | avg. % zinc recovered |
|---|---|---|---|---|
| 1A | 0 | 100 | 93.9 | |
| 1B | 0 | 100 | 95.9 | 94.9 |
| 2A | 10 | 90 | 98.2 | |
| 2B | 10 | 90 | 98.2 | 98.2 |
| 3A | 20 | 80 | 99.8 | |
| 3B | 20 | 80 | 99.9 | 99.9 |
| 4A | 30 | 70 | 96.5 | |
| 4B | 30 | 70 | 96.5 | 96.5 |
| 5A | 40 | 60 | 99 | |
| 5B | 40 | 60 | 99.2 | 99.1 |
| 6A | 50 | 50 | 95 | |
| 6B | 50 | 50 | 95 | 95 |
| 7A | 100 | 0 | 86.5 | |
| 7B | 100 | 0 | 86.3 | 86.4 |

EXAMPLES 8 to 14

Sphalerite Recovery Using a Combination of Isopropyl Xanthate and Allylhexylthionocarbamate Examples 8 to 14 provide sphalerite recovery using a combination of isopropyl xanthate and allylhexylthionocarbamate using the same procedure as for Examples 1 to 7, except that Examples 8 to 14 of Table II represent results when using the combination of isopropyl xanthate and allylhexylthionocarbamate rather than butyl xanthate and allylisobutyl thionocarbamate.

In Table II, the concentrate and tailing samples are dewatered and analyzed for their zinc content.

TABLE II

| Examples | % allylhexyl-thionocarbamate | % isopropyl xanthate | % zinc recovered |
|---|---|---|---|
| 8 | 1 | 99 | 93.8 |
| 9 | 10 | 90 | 97.9 |
| 10 | 20 | 80 | 99.4 |
| 11 | 30 | 70 | 98.2 |
| 12 | 40 | 60 | 98.8 |
| 13 | 50 | 50 | 94.6 |
| 14 | 100 | 0 | 84.2 |

EXAMPLES 15 to 21

Sphalerite Recovery Using a Combination of Ethylxanthate and Allyloctylthionocarbamate Examples 15 to 21 provide sphalerite recovery using a combination of ethyl xanthate and allyloctylthionocarbamate using the same procedure as for Examples 1 to 7, except that Examples 15 to 21 of Table III represent results when using the combination of ethyl xanthate and allylisobutylthionocarbamate rather than butyl xanthate and allylisobutyl thionocarbamate.

In Table III, the concentrate and tailing samples are dewatered and analyzed for their zinc content.

TABLE III

| Examples | % allyloctyl-thionocarbamate | % ethyl xanthate | % zinc recovered |
|---|---|---|---|
| 15 | 1 | 99 | 92.8 |
| 16 | 10 | 90 | 96.4 |
| 17 | 20 | 80 | 98.1 |
| 18 | 30 | 70 | 94.2 |
| 19 | 40 | 60 | 97.3 |
| 20 | 50 | 50 | 92.9 |
| 21 | 100 | 0 | 84.7 |

The above set of examples demonstrate that the optimum concentration of allylalkylthionocarbamate to butyl xanthate for the recovery of sphalerite (zinc sulfide) is about 20:80.

It will be appreciated that variations and modifications to the compositions and processes can be made by the skilled person without departing from the spirit or scope of the invention as defined in the appended claims.

What is claimed is:

1. A collector composition for froth flotation of metal sulfide minerals comprising the combination of 1 ) at least one allylalkylthionocarbamate compound having the formula $$CH_2{=}CHCH_2NHC(=S)-OR,$$

wherein R is a $C_2$ to $C_8$ alkyl radical, and 2) a xanthate having the formula $$R'O-C(=S)-S^-M^+,$$

wherein R' is a $C_2$ to $C_8$ alkyl radical.

2. A collector composition as defined in claim 1 wherein R is isobutyl.

3. A collector composition as defined in claim 1 wherein R' of the xanthate is a $C_4$ alkyl.

4. A collector composition as defined in claim 1 wherein R' is butyl.

5. A collector composition as defined in claim 1 wherein R' is isopropyl.

6. A collector composition as defined in claim 1 wherein the concentration ratio of said thionocarbamate to xanthate is from about 1:99 to 50:50.

7. A collector as defined in claim 6 wherein the concentration ratio of said thionocarbamate to xanthate is 10:90 to 40:60.

8. A collector composition as defined in claim 1 wherein said metal sulfide minerals are sphalerite or copper sulfide.

9. In a froth flotation process for beneficiating an ore containing sulfide minerals comprising forming slurry liberation-sized particles of said ore in an aqueous medium, conditioning said slurry with effective amounts of a frothing agent and a metal collector, respectively, and frothing the desired sulfide minerals by froth flotation, the improvement comprising: employing as the metal collector the combination of 1 ) at least one allylalkylthionocarbamate compound having the formula $$CH_2{=}CHCH_2NH\overset{\overset{\displaystyle S}{\|}}{C}{-}OR,$$

wherein R is a $C_2$ to $C_8$ alkyl radical, and 2) a xanthate having from the formula $$R'O{-}\overset{\overset{\displaystyle S}{\|}}{C}{-}S^{-}M^{+},$$

wherein R' is a $C_2$ to $C_8$ alkyl radical.

10. A process as recited in claim 9 wherein R is isopropyl.

11. A process as recited in claim 9 wherein R' is a $C_4$ alkyl.

12. A process as recited in claim 9 wherein R' is butyl.

13. A process as recited in claim 9 wherein R' is isopropyl.

14. A process as recited in claim 9 wherein the concentration ratio of said thionocarbamate to xanthate is from about 1:99 to 50:50.

15. A process as recited in claim 9 wherein the concentration ratio of said thionocarbamate to xanthate is 10:90 to 40:60.

16. A process as recited in claim 9 wherein said metal sulfide minerals are sphalerite or copper sulfide.

17. A process as recited in claim 9 wherein said metal collector is added in an amount of from about 0.005 to about 0.5 lb/T of ore.

* * * * *